US010297948B2

(12) United States Patent
Haunberger et al.

(10) Patent No.: US 10,297,948 B2
(45) Date of Patent: May 21, 2019

(54) ANTI-KINK PROTECTION ASSEMBLY AND METHOD FOR INSTALLING THE ANTI-KINK PROTECTOR

(71) Applicant: Kathrein Werke KG, Rosenheim (DE)

(72) Inventors: Thomas Haunberger, Rosenheim (DE); Mario Günther, Rosenheim (DE); Sebastian Stohn, Rosenheim (DE); Andreas Scheyer, Rosenheim (DE)

(73) Assignee: KATHREIN WERKE KG, Rosenheim (DE)

( * ) Notice: Subject to any disclaimer, the term of this patent is extended or adjusted under 35 U.S.C. 154(b) by 0 days.

(21) Appl. No.: 15/666,178

(22) Filed: Aug. 1, 2017

(65) Prior Publication Data

US 2018/0034199 A1 Feb. 1, 2018

(30) Foreign Application Priority Data

Aug. 1, 2016 (DE) ..... 10 2016 114166

(51) Int. Cl.
*H01R 13/58* (2006.01)
*H01R 9/05* (2006.01)
(Continued)

(52) U.S. Cl.
CPC ..... *H01R 13/58* (2013.01); *H01R 9/05* (2013.01); *H01R 13/562* (2013.01);
(Continued)

(58) Field of Classification Search
CPC ..... H01R 13/5812; H01R 13/5837; H01R 13/5804; H01R 13/595; H01R 13/506; H01R 23/025
(Continued)

(56) References Cited

U.S. PATENT DOCUMENTS 4,191,443 A * 3/1980 Doyle ..... H01R 13/506 439/462
5,866,853 A * 2/1999 Sheehan ..... H02G 3/0675 174/153 R
(Continued)

FOREIGN PATENT DOCUMENTS

DE 3534625 C2 9/1988
DE 4439852 A1 5/1996
(Continued)

*Primary Examiner* — Hien D Vu
(74) *Attorney, Agent, or Firm* — Fish IP Law, LLP

(57) ABSTRACT

An anti-kink protection assembly is proposed that is configured for being situated on a connector housing that is mounted on a cable for anti-kink protection, comprising a cylindrical base part that is formed in one piece from a top part and a bottom part. The bottom part includes multiple locking arms that are separated from one another by a distance in the radial direction, and locking tabs are in each case situated on the lower end areas of the locking arms facing away from the top part, in the direction of the inner area of the cylindrical base part. The bottom part has a defined internal cross section in the area of the locking arms without the locking tabs. Tt least one upper end element is situated at the upper outer edge of the top part facing away from the locking arms. In addition, the anti-kink protection assembly includes a ring that is configured for being pushed over the bottom part of the base part onto the top part in a preassembly step, and for abutting against the at least one upper end element, and in a final assembly step, being pushed in the opposite direction with respect to the preassembly step, from the top part in the direction of the bottom part, until reaching the lower end areas of the locking arms.

14 Claims, 1 Drawing Sheet

(51) Int. Cl.

| | |
|---|---|
| ***H01R 43/00*** | (2006.01) |
| ***H01R 13/56*** | (2006.01) |
| *H01R 103/00* | (2006.01) |
| *H01R 13/506* | (2006.01) |
| *H01R 24/40* | (2011.01) |

(52) U.S. Cl.
CPC ..... *H01R 43/002* (2013.01); *H01R 13/506* (2013.01); *H01R 13/5812* (2013.01); *H01R 24/40* (2013.01); *H01R 2103/00* (2013.01)

(58) Field of Classification Search
USPC ..... 439/460, 470, 472
See application file for complete search history.

(56) References Cited

U.S. PATENT DOCUMENTS

| | | | | |
|---|---|---|---|---|
| 7,938,674 | B2 * | 5/2011 | Lindkamp ..... | H01R 13/59 439/461 |
| 9,147,971 | B2 * | 9/2015 | Osada ..... | H01R 13/639 |

FOREIGN PATENT DOCUMENTS

| | | | |
|---|---|---|---|
| DE | 102006036812 | A1 | 2/2008 |
| EP | 2690719 | B1 | 9/2016 |

* cited by examiner

ANTI-KINK PROTECTION ASSEMBLY AND METHOD FOR INSTALLING THE ANTI-KINK PROTECTOR

This application claims the benefit of priority to German Application No. 10 2016 114 166.6, filed Aug. 1, 2016.

FIELD OF THE INVENTION

The invention relates to an anti-kink protection assembly, in particular a protector for the soldering point of an external conductor of a coaxial cable, according to the preamble of independent claim 1, and an installation method.

BACKGROUND

Electrical plug-in connections are required for various uses, for example as connections for coaxial cables in high-frequency applications, or as connections for other components with one another and with cables, for example in the automotive field. In this regard, kinking or bending of the cable at or near its connection to the socket may be problematic. This may result in the cable breaking at the transition from hard to soft, i.e., primarily at the soldering point. Various anti-kink protection assemblies are already known for avoiding kinking of a cable, also of high-frequency (HF) cables. An anti-kink protector requires a certain length away from the soldering point, and for hard material such as plastic it may have a tapered design in the shape of a funnel, or for a soft material such as rubber it may also have a thin-walled design. Known anti-kink protection assemblies may at the same time be designed for strain relief, and may include, first of all, a strain relief element, and then at the free end, an anti-kink protector.

Thus, for example, rubber or heat-shrink tubes are known, which are pulled over the cable and the socket and which may also be melted by heating, resulting in stabilization of the cable at the connection to the socket. Such anti-kink protection grommets are, for example, the HV2101 anti-kink protection grommet manufactured by HellermannTyton.

Slip-on grommets are also known, which are already mounted on the cable during preassembly and then placed over the cable and socket or connector housing. Alternatively, grommets are known which are either made up of two parts which are clicked over the cable and the connector housing, or in which the parts may be joined together on one side via hinges. Such anti-kink protection grommets are known for the known RJ45 plug, for example, or are manufactured by CLIFF® as the DCPP3 DC line connector.

In addition, a securing element for a cylindrical base part for cable guides via locking arms is known from German Patent application DE 35 34 625 A1. Furthermore, a plug-in connector system is known from German Patent application DE 10 2006 036 812 A1, in which a sliding sleeve is movable between a locked position and an unlocked position.

Moreover, an anti-kink protection assembly is known from European Patent EP 2 690 719 B1, and an HF plug-in connection is known from German Patent application DE 44 39 852 A1.

However, in all of the anti-kink protection grommets known thus far, there is the problem that significantly higher forces act on the cable-connector housing connection for HF applications than for network applications, for example. In addition, for passive intermodulation (PIM) applications, for example, even the smallest cracks at the external conductor or at the soldering point are problematic [for] an undefined contact situation. To date, anti-kink protection assemblies have usually been combined with a strain relief element. That is, in the known prior art, the locking tabs with which the anti-kink protector is mounted on the connector housing represent the main problem. Since coaxial cables are very hard and sometimes also very thick, and therefore an anti-kink protector in question must be correspondingly harder than the cable, i.e., must not break or give way when the cable is bent, the required load capacity of the anti-kink protector is very high.

SUMMARY OF THE INVENTION

The object of the present invention, therefore, is to provide an anti-kink protection assembly that is able to absorb the above-mentioned loads and at the same time is economical and easy to manufacture, and a method for installing the anti-kink protector. This object is achieved according to the invention by the features of the independent patent claims. Advantageous embodiments are the subject matter of the dependent claims.

An anti-kink protection assembly is proposed that is configured for being situated on a connector housing that is mounted on a cable for anti-kink protection, comprising a cylindrical base part that is formed in one piece from a top part and a bottom part, wherein the bottom part includes multiple locking arms that are separated from one another by a distance in the radial direction, and locking tabs are in each case situated on the lower end areas of the locking arms facing away from the top part, in the direction of the inner area of the cylindrical base part, wherein the bottom part has a defined internal cross section in the area of the locking arms without the locking tabs, wherein at least one upper end element is situated at the upper outer edge of the top part facing away from the locking arms. In addition, the anti-kink protection assembly includes a ring that is configured for being pushed over the bottom part of the base part onto the top part in a preassembly step, and for abutting against the at least one upper end element, and in a final assembly step, being pushed in the opposite direction with respect to the preassembly step, over or from the top part in the direction of the bottom part until reaching the lower end areas of the locking arms.

Due to providing the combination of the base part having a constant internal cross section of the bottom part in the area of the locking arms without the locking tabs, and a ring for reinforcement, only an undercut at the locking arms is necessary. The manufacture is thus simplified and optimized, since an undercut is required during injection molding of the plastic part, for which a slider, which would expand during insertion, is not needed. In addition, the ring provides additional stiffening, i.e., reinforced anti-kink protection, when the locking arms or locking tabs are locked to the connector housing after the final assembly step. Alternatively, the ring may additionally contribute to the locking of the locking arms, or may make this possible in the first place. In principle, three areas of the anti-kink protection assembly may have different internal cross sections, namely, the area for supporting the cable in the upper area, i.e., at least a portion of the top part, the locking arms without the locking tabs, and the locking tabs.

In another embodiment, it is provided that the locking arms at their upper ends facing the top part have locking projections at a distance from the lower end of the particular locking projection to the lower end of the particular locking arm. The distance advantageously corresponds to the width of the ring. The width of the area of the top part onto which the ring is pushed, from the lower end of the at least one upper end element to the upper end of the locking projections, advantageously corresponds to the width of the ring. A compact arrangement is provided in this way.

In another embodiment, it is provided that after the final assembly step, the ring with its upper end abuts against the locking projections. The ring is thus prevented from sliding out at the top.

In another embodiment, it is provided that the bottom part includes three, four, five, or six locking arms. In another embodiment, it is provided that the top part includes three, four, five, or six upper end elements designed as stop elements or locking elements, or includes an at least partially circumferential edge.

In another embodiment, it is provided that the internal cross section in the area of the locking arms is constant or becomes larger in the direction of the locking tabs or of the upper end elements. The design is selected depending on the application. When the internal cross section becomes larger in the direction of the upper end elements, the locking arms in the installed state then have a constant internal cross section, so that they already have pretensioning in this state. When the internal cross section becomes larger in the direction of the locking tabs, the locking tabs do not engage until the ring is pushed on.

The enlargement of the internal cross section may be stepwise or also constantly or continuously increasing, as long as it is ensured that the base part is mountable on the connector housing. The shape of the internal cross section is not consistently circular. The locking tabs require sliders, and on the other hand the inner area should also support the smaller diameter of the cable. The cross section is thus smaller in the area of the locking tabs. This results in webs or grooves for the internal cross section, as is apparent in FIGS. 2 and 3 at the locations where the cable enters into the top part.

In another embodiment, it is provided that the locking arms are formed from the top part and arranged thereon in such a way that they have a predetermined elasticity.

Also provided within the scope of the present invention is a method for installing the anti-kink protector, according to one of the preceding claims, on a connector housing that includes a cable, wherein in a preassembly step for producing a preassembled anti-kink protector, the ring is pushed over the bottom part of the base part onto the top part until reaching the at least one upper end element, and wherein subsequently either the anti-kink protector is pushed over a cable that is to be fastened to a connector housing and the cable is connected to the connector housing, or the cable that is to be fastened to the connector housing is connected to the connector housing and the preassembled anti-kink protector is subsequently pushed over the cable, and in a final assembly step the ring is pushed in the opposite direction with respect to the preassembly step, over the top part in the direction of the bottom part, until reaching the lower end areas of the locking arms.

In one embodiment, it is provided that the locking tabs of the anti-kink protector are pushed apart during installation in order to lock to an area of the connector housing, and after installation, the locking tabs lock on the connector housing at the provided area of the connector housing, or the locking takes place by sliding the ring over.

Further features and advantages of the invention result from the following description of exemplary embodiments of the invention, with reference to the figures of the drawing which show particulars according to the invention, and from the claims. The individual features may each be implemented individually or collectively in any combination in a variant of the invention.

Preferred embodiments of the invention are explained in greater detail below with reference to the appended drawings.

BRIEF DESCRIPTION OF THE DRAWING

Identical elements or functions are provided with the same reference numerals in the following description of the figures.

DETAILED DESCRIPTION

Figure 1:
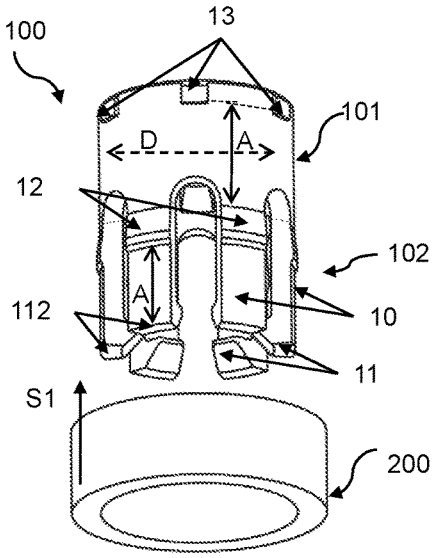
FIG. 1 shows a view of an anti-kink protection assembly for preassembly according to one embodiment of the present invention.
Figure 2:
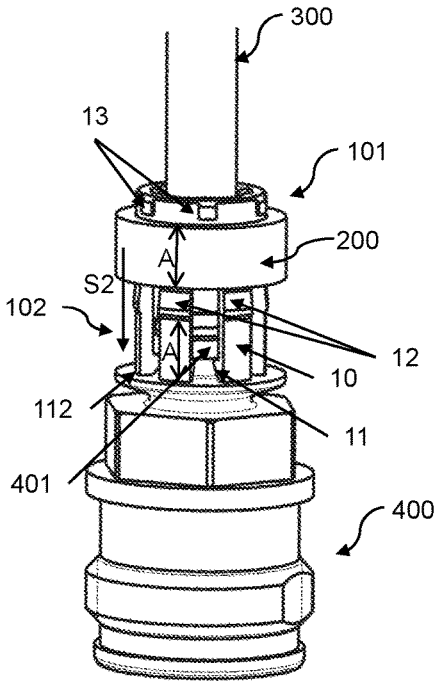
FIG. 2 shows a preassembled anti-kink protection assembly for installation on a cable and a connector housing according to one embodiment of the present invention.
Figure 3:
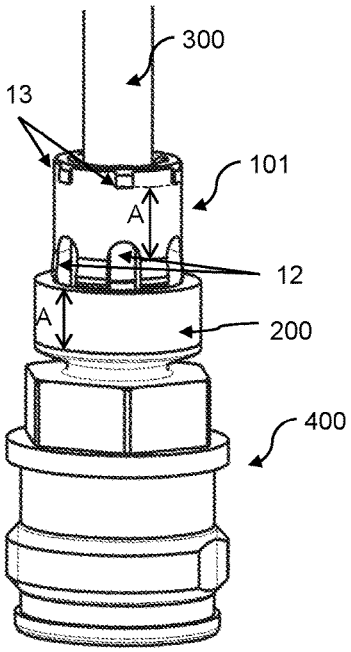
FIG. 3 shows a completely installed anti-kink protection assembly after installation on a cable and a connector housing according to one embodiment of the present invention.

FIGS. 1 through 3 respectively show views of an anti-kink protection assembly for preassembly, in the preassembled state for installation on a cable 300 together with a connector housing or socket 400, and in the completely installed state according to one embodiment of the present invention.

The anti-kink protection assembly comprises two separate parts, as shown in FIG. 1, namely, a cylindrical base part 100, also referred to as a crown sleeve, and a ring 200. The cylindrical base part 100 is formed in one piece from a top part 101 and a bottom part 102. In a preassembly step S1, illustrated as an arrow in FIG. 1, the ring 200 is pushed over the bottom part 102 onto an area of the top part 101 until reaching upper end elements, which in the figures are designed as stop elements 13 for purposes of illustration. However, the upper end elements 13 may also be designed as locking elements or as an at least partially circumferential edge. This state is the preassembly state. In this state, the anti-kink protection assembly may be pushed over a cable 300 that is to be connected to a connector housing 400, such as a socket, as described below.

On the upper side, i.e., the side facing away from the bottom part 102, the top part 101 has at least one stop element 13. More than one stop element 13 is advantageously formed on the upper end of the top part 101, so that a uniform abutment of the ring 200, which abuts against the stop elements 13 after preassembly, takes place over the entire radius of the cylindrical base part 100. It is apparent in FIGS. 1 through 3 that the stop elements 13 are situated above the midpoint of the distance between the locking arms 10. However, the invention is not limited thereto. The stop elements 13 may be situated at any locations at the upper end of the top part 101, provided that a uniform abutment of the ring 200 is ensured. In addition, the body of the top part 101 preferably has the same width A as the ring 200, so that spreading apart the locking arms 10 during mounting on a collar 401, such as a heat trap of the connector housing 400, for example a socket, is not hindered.

The bottom part 102 includes multiple locking arms 10 that are separated at a distance from one another in the radial direction. Locking tabs 11 are situated on the lower end areas of the locking arms 10 facing away from the top part 101 in the direction of the inner area of the cylindrical base part 100. The locking tabs 11 are formed in such a way that they are able to lock, i.e., snap or hook, into [or] onto a collar 401, for example a heat trap, of a connector housing 400, for example a socket, after the anti-kink protection assembly, which is already situated on the cable 300, has been pushed over the cable 300 in the direction of the connector housing 401.

It is shown in FIG. 1 that the upper ends of the locking arms 10 terminate with an arch facing the top part 101. This has the advantage that producing an arched cutout from the base part 100 is simple, and the shape has a certain stability and elasticity per se. However, the invention is not limited to the arched shape as shown in FIG. 1. Rather, any shape that meets the criteria of stability and elasticity as well as ease of manufacture may be used.

In addition, the locking arms 10 may have locking projections 12 at their upper end, i.e., the area facing the top part 101. The locking arms are formed in such a way that the ring 200 is pushed over these locking projections 12 after the anti-kink protection assembly is installed on the cable 300 and the connector housing 400, and the locking projections 12 prevent the ring 200 from moving back in the direction of the top part 101. The distance from the lower end 112, more precisely, the lower end at which the ring 200 is to abut, of the locking arms to the locking projections 12, which are to keep the ring 200 from sliding up in the direction of the top part 101, advantageously corresponds at least to the width A of the ring 200.

The internal cross section D, shown in FIG. 1 as a dashed line merely for purposes of illustration, may be constant for the base part 100, in particular the bottom part 102 in the area of the locking arms without the locking tabs 11. That is, it is not necessary to provide an undercut that is difficult to create, or to produce locking arms 10 that extend outwardly from the top part 101 and downwardly at an angle. Rather, the base part 100 may be injection-molded from a single piece. Locking tabs 11 and locking projections 12 may thus be easily injection-molded together. The internal cross section D is advantageously only slightly larger than the cable 300 over which the anti-kink protector device is to be pushed. In addition, a portion of the top part 101 may have the same internal cross section D, whereby at its upper end area it will generally have a smaller internal diameter in order to guide or support the cable. This internal diameter is defined by the grooves that are present at the upper end area of the top part on account of the sliders for the locking tabs.

In the preassembled state shown in FIG. 2, the anti-kink protection assembly shown in the figures is mounted on a cable 300; i.e., the ring 200 is pushed onto the cylindrical base part 100 and secured to the stop elements 13 to prevent falling out at the top. The top part 101 of the base element 100 advantageously has the same width A as the ring 200. The cable 300, over which the anti-kink protection assembly is already mounted, is connected to a connector housing 400, and in a final assembly step S2 the anti-kink protection assembly is then pushed over the cable 300 in the direction of the connector housing 400, which is a socket, for example, and is pushed over a collar 401 present at that location with an undercut, which, for example, is a heat trap of the solder cup, in order to lock to it. Lastly, the ring 200 is pushed from the top part 101 in the direction of the bottom part 102 until reaching the lower end 112 of the locking arms 11, in order to be used as a lock and reinforcement, as shown in FIG. 3. The ring 200 may then be used as a lock when the locking tabs 11 do not lock at that location after mounting on the collar 401, the heat trap, for example; i.e., the ring 200 may be used for pressing the locking arms 10 together so that the locking tabs 11 engage with the collar 401 and thus interlock. However, the locking arms 10 may also be formed in such a way that they are spread apart during mounting on the collar 401, and then automatically snap back into their starting position so that they lock behind the collar 401. The ring 200 is then used here as reinforcement and for securing the locking arms 10 from snapping out or spreading.

Depending on the design of the anti-kink protection assembly, three, four, five, or six locking arms 10 may be provided. In addition, depending on the design of the anti-kink protection assembly, three, four, five, or six upper end elements, i.e., stop elements or locking elements 13, for example, may be provided. The number of stop elements or locking elements 13 may also correspond to the number of locking arms 10. The number of locking arms 10 and stop elements or locking elements 13 is selected by those skilled in the art based, for example, on the thickness of the cable to be protected from kinking, or forces that are expected to occur, also during handling of the system, for example. An at least partially circumferential edge may also be selected as the upper end element.

The anti-kink protection assembly is advantageously made from a material, for example plastic, by injection molding. It is also advantageous for the material to be selected in such a way that it provides at least low elasticity for the locking arms 10 so that they may be spread over the collar 401 of the connector housing 400 and bent back into their starting position, or so that they move back into this position by themselves.

As a result of the present invention, the intermodulation stability is ensured even during bending of a thick HF cable, since the stress that is mechanically applied due to the bending does not act on the soldering point at which the cable is connected to the connector housing. In addition, manufacturing is economical, and it is not necessary to apply heat to achieve anti-kink protection. Furthermore, installation is easy, since heat traps that are present at sockets may be used as a locking area for the locking tabs. The present invention provides an anti-kink protection assembly, in particular, a protector for the soldering point of an external conductor of a coaxial cable, not of a crimping point of the cable on the connector housing. This anti-kink protection assembly can absorb bending forces, but does not act as a strain relief element.

LIST OF REFERENCE NUMERALS

100 base part
101 top part
102 bottom part
10 locking arms
112 lower end of the locking arm
11 locking tab
12 locking projection
13 upper end elements
200 ring
300 cable
400 connector housing or socket
401 collar or heat trap
D internal cross section
A distance from the lower end of the locking arm to the lower end of the locking projection, width of the ring, width of the top part
S1 preassembly step
S2 final assembly step

What is claimed is:

1. An anti-kink protection assembly (100, 200) that is configured for being situated on a connector housing (400) that is connected to a cable (300) for anti-kink protection, comprising:

a cylindrical base part (100) that is formed in one piece from a top part (101) and a bottom part (102), wherein the bottom part (102) includes multiple locking arms (10) that are separated from one another by a distance in the radial direction, and locking tabs (11) are in each case situated on the lower end areas (112) of the multiple locking arms (10) facing away from the top part (101), in the a direction of the an inner area of the cylindrical base part (100), wherein the bottom part (102) has a defined internal cross section (D) in the area where the locking arms (10) are without the locking tabs (11), wherein at least one upper end element (13) is situated at an upper outer edge of the top part (101) and spaced away from the locking arms (10), and a ring (200) that is configured and designed for being pushed over the bottom part (102) of the base part (100) onto and toward an area of the top part (101) in a preassembly step (Si), and for abutting against the at least one upper end element (13), and in a final assembly step (S2), thereafter being pushed in an opposite direction with respect to the preassembly step (51), from the top part (101) in the direction of the bottom part (102), until reaching the lower end areas of the locking arms (10).

2. The anti-kink protection assembly (100, 200) according to claim 1, wherein each of the locking arms (10), at an upper end facing the top part (101), have locking projections (12), each at a distance (A) from a lower end of the particular locking projection (12) facing away from the top part (101), to the lower end area (112) of the locking arm (10) facing away from the top part (101).

3. The anti-kink protection assembly (100, 200) according to claim 2, wherein the ring (200) has an upper end that abuts against the locking projections (12) after the final assembly step (S2).

4. The anti-kink protection assembly (100, 200) according to claim 2, wherein the distance (A) corresponds to a width of the ring (200).

5. The anti-kink protection assembly (100, 200) according to claim 3, wherein the distance (A) corresponds to the width of the ring (200).

6. The anti-kink protection assembly (100, 200) according to claim 4, wherein a width of an area of the top part (101) between the lower end of the at least one end element (13) facing the bottom part (102) and the upper end of one of the locking projections (12) facing the top part (101) corresponds to the distance (A), and the ring (200) is pushed onto the area of the top part (101) in the preassembly step.

7. The anti-kink protection assembly (100, 200) according to claim 5, wherein a width of an area of the top part (101) between the lower end of the at least one end element (13) facing the bottom part (102) and the upper end of one of the locking projections (12) facing the top part (101) corresponds to the distance (A), and the ring (200) is pushed onto the area of the top part (101) in the preassembly step.

8. The anti-kink protection assembly (100, 200) according claim 7, wherein the bottom part (102) includes three, four, five, or six locking arms (10), and/or the top part (101) includes three, four, five, or six stop elements or locking elements configured as upper end elements (13) or as an at least partially circumferential edge.

9. The anti-kink protection assembly (100, 200) according claim 6, wherein the bottom part (102) includes three, four, five, or six locking arms (10), and/or the top part (101) includes three, four, five, or six stop elements or locking elements configured as upper end elements (13) or as an at least partially circumferential edge.

10. The anti-kink protection assembly (100, 200) according to claim 9, wherein the internal cross section in the area of the locking arms (10) is constant or becomes larger in the direction of the locking tabs (11) or of the upper end elements (13).

11. The anti-kink protection assembly (100, 200) according to o claim 9, wherein the locking arms (10) are made of a material, and formed from the top part (101) and situated thereon, in such a way that the locking arms (10) have a predetermined elasticity.

12. The anti-kink protection assembly (100, 200) according to claim 1, wherein the internal cross section in the area of the locking arms (10) is constant or becomes larger in the direction of the locking tabs (11) or of the upper end elements (13).

13. The anti-kink protection assembly (100, 200) according to o claim 1, wherein the locking arms (10) are made of a material, and formed from the top part (101) and situated thereon, in such a way that the locking arms (10) have a predetermined elasticity.

14. The anti-kink protection assembly (100, 200) according to o claim 2, wherein the locking arms (10) are made of a material, and formed from the top part (101) and situated thereon, in such a way that the locking arms (10) have a predetermined elasticity.

* * * * *